United States Patent [19]

Lorenz et al.

[11] 4,352,042

[45] Sep. 28, 1982

[54] LUMINESCENT SCREENS FOR FLAT IMAGE DISPLAY DEVICES

[75] Inventors: Hans P. Lorenz, Schwarzenbruck; Rolf Wengert, Munich, both of Fed. Rep. of Germany

[73] Assignee: Siemens Aktiengesellschaft, Berlin & Munich, Fed. Rep. of Germany

[21] Appl. No.: 101,584

[22] Filed: Dec. 10, 1979

[30] Foreign Application Priority Data

Dec. 20, 1978 [DE] Fed. Rep. of Germany ..... 2855090

[51] Int. Cl.[3] ..... H01J 17/49; H01J 61/42

[52] U.S. Cl. ..... 313/485; 313/461

[58] Field of Search ..... 313/485, 495, 461, 188, 313/472, 484

[56] References Cited

U.S. PATENT DOCUMENTS

| | | | |
|---|---|---|---|
| 2,509,071 | 5/1950 | Pennybacker | 313/488 X |
| 3,619,698 | 11/1971 | Caras | 313/114 X |
| 3,845,241 | 10/1974 | Schwartz | 313/485 X |
| 3,858,083 | 12/1974 | Rehkopf et al. | 313/472 |
| 3,934,172 | 1/1976 | Okamoto | 313/188 X |
| 3,956,667 | 5/1976 | Veith | 315/169 |
| 4,047,077 | 9/1977 | Veith | 313/195 X |
| 4,205,255 | 5/1980 | Tomita | 313/472 X |

FOREIGN PATENT DOCUMENTS

| | | | |
|---|---|---|---|
| 2806436 | 2/1978 | Fed. Rep. of Germany . | |
| 2745101 | 4/1979 | Fed. Rep. of Germany | 313/485 |
| 2278152 | 2/1976 | France | 313/484 |
| 508820 | 5/1976 | U.S.S.R. | 313/484 |
| 601724 | 5/1978 | U.S.S.R. | 313/485 |

*Primary Examiner*—Palmer C. Demeo

*Attorney, Agent, or Firm*—Hill, Van Santen, Steadman, Chiara & Simpson

[57] ABSTRACT

A luminescent screen for flat image display devices, having improved light efficiency comprises a perforated plate (5) positioned on the inside of a luminescent screen glass (1), with the plate holes (6) extending above the individual spaced-apart luminescent areas or phosphor dots and the hole walls (6a) being provided with a metallization layer (8) and/or an extension of the luminescent layer (7) on the glass screen (1). In preferred embodiments, the plate holes are etched so that each hole is enlarged toward the front of the screen and the walls thereof assumes at least an approximately parabolical shape opening toward the glass screen and such angular walls are at least partially coated with a metal layer and/or a luminescent material layer for further improved light efficiency (FIG. 4).

13 Claims, 5 Drawing Figures

LUMINESCENT SCREENS FOR FLAT IMAGE DISPLAY DEVICES

BACKGROUND OF THE INVENTION

1. Field of the Invention

The invention relates to luminescent screens for flat image display devices and somewhat more particularly to such screens wherein the individual luminescent dots are separated from one another by a black border layer.

2. Prior Art

Flat image display devices functioning in accordance with the principles of gas discharge displays, as plasma panels or plasma displays are known, for example see German Offenlegungsschrift No. 24 12 869 (generally corresponding to U.S. Pat. No. 3,956,667). In such flat image display devices, i.e., image display devices using a flat picture screen, a fine-grained luminescent screen with a high light efficiency is required. Plasma in such devices functions as the actual cathode, from which an electron beam is drawn over a perforated control panel having a matrix control for each luminescent point to be excited. In comparison to a classic cathode beam image tube, where a single electron beam must reach all luminescent points, which, with typical large image tube dimensions, requires very high beam acceleration, the electron beam in gas discharge display devices is a relatively low energy beam. Further, due to the flat screen structure and the gaseous atmosphere in such devices, high acceleration voltages are not possible. Therefore, it is extremely important for luminescent screens in flat image display devices to obtain a high light efficiency after conversion of electron energy into light or after light generation from the luminescent points or phosphor dots via, for example, impingement on such points or dots by ultraviolet radiation.

For improving light efficiency in classic cathode ray tubes it is known to coat the luminescent material points or dots on their inner surfaces (i.e., away from the viewing surface) with a mirroring ring or reflecting metal layer, for example as described in U.S. Pat. No. 3,858,083. In this manner, light emitted by excited luminescent material toward the back or rear of a so-called luminescent dot is largely reflected by this metal layer and added to the light emitted toward the front. However, the excited electrodes are also weakened by this metal layer. Such partial electron de-energization is not overly detrimental for high-energy cathode beam electrons but with low-energy electrons used in flat plasma display devices, the use of such metal mirror is detrimental.

It is also known in classic cathode ray tubes to isolate individual luminescent points or dots from each other by opaque borders, for example from the earlier referenced U.S. Pat. No. 3,858,083. In conjunction with flat image display devices, such opaque borders are described and claimed in co-pending U.S. application Ser. No. 012,348 filed Feb. 15, 1979, now U.S. Pat. No. 4,243,735.

SUMMARY OF THE INVENTION

The invention provides a luminescent screen with black-bordered luminescent points and which has an improved light efficiency and color purity without negative effects on the energy-carriers causing or generating light.

In accordance with the principles of the invention, a luminescent screen for flat image display devices with electron beams drawnout of a gas discharge with an acceleration anode for such electron beams is comprised of glass screen plate positioned on the inside (away from a viewer) of a luminescent screen for supporting a perforated plate above a black or opaque border layer on a conductive layer in direct contact with the glass screen plate. In accordance with the principles of the invention, the perforated plate is provided with a through-hole over every luminescent point or dot on the screen plate, with the interior walls of such through-holes, at least on the wall areas thereof adjacent and facing the glass screen plate, being provided with a light-efficiency increasing for cooperatively interacting with the luminescent points or dots for directing electrons reflected against the through-hole walls from the luminescent points back toward luminescent points means. In one embodiment, such light-efficiency increasing means comprises a metal layer. In another embodiment, such means comprises a layer of luminescent material which, is an extension of the luminescent material dot applied beneath the hole on the glass screen plate so as to be extended up from the dot onto the through-hole wall areas. In a preferred embodiment, the light-efficiency increasing means comprises a combination of a metal layer and a luminescent material layer, with the metal layer being in direct contact with the hole wall surfaces and the luminescent material being in contact with the metal layer. With all the embodiments, the hole walls can be shaped, as by etching, so as to angle outward toward the glass screen plate (i.e., so that the hole dimension at the glass screen plate is larger than at an interior hole area). Preferably, the hole walls are shaped so as to assume an at least approximately parabolic shape.

By following the principles of the invention, the active luminescent material surface can be significantly increased or better exploited with the assistance of the inventive luminescent screen structure described, in comparison to screens having unmodified luminescent point or dot surface layer. With the invention structure more electrons reach luminescent material particles which emit their light to all sides, i.e., also toward the front. The amount of light emitted toward the front becomes significantly greater per luminescent point with the inventive structure than when an un-mirrored luminescent surface is utilized, which only corresponds to a plurality of spaced-apart luminescent points and lies only in the plane of such luminescent points.

With the inventive structure, the perforated plate separates the luminescent points from one another. In this manner, no reflected electrons scattered at one luminescent point can reach a neighboring or adjacent luminescent point. Due to this de-coupling of luminescent points, color contrast and purity are significantly improved, relative to that attained with purely planar screen structures. Further, reflected electrons add significantly to increase the light efficiency when they strike additional luminescent points or dots of the same color.

DESCRIPTION OF THE PREFERRED EMBODIMENTS

Figure 1:
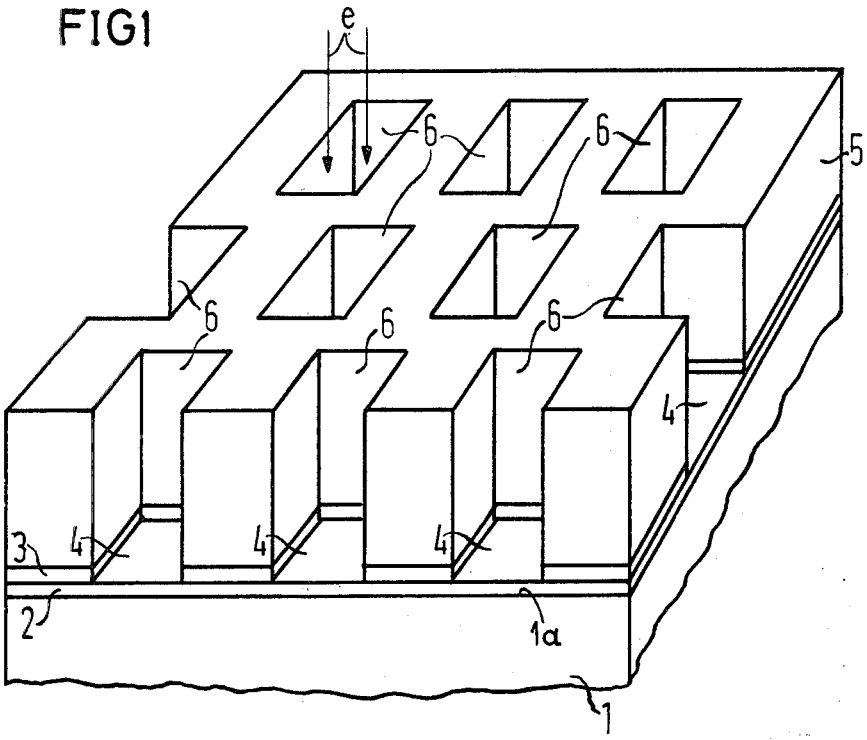
FIG. 1 is a partial perspective and somewhat schematic view of a luminescent screen constructed in accordance with the principles of the invention.

The invention provides luminescent screens for flat image display devices having a high light efficiency and improved color purity.

In accordance with the principles of the invention, flat image display luminescent screens are comprised of:

(a) a glass screen plate positioned on the inside of a luminescent screen structure for supporting a perforated plate positioned above a black border layer (which itself is positioned on a conductive layer in direct contact with the glass plate), such perforated plate having a pattern of through-holes, with each hole being positioned over each luminescent point or dot of the screen;

(b) the walls of each through-hole in the perforated plate, at least on the wall portions thereof adjacent and facing the glass plate, having:

($b_1$) either a metal layer;

($b_2$) or a luminescent material layer, which, as an extension of the luminescent material point positioned beneath the hole is extended continually upwardly on the adjacent hole wall portions;

($b_3$) or both, a metal layer and a luminescent layer;

whereby in alternative ($b_1$) with metallization, the hole walls are angled outwardly toward the glass screen and in alternative ($b_3$) the extended luminescent material layer is positioned on the metal layer.

In comparison with alternative ($b_2$), i.e., only an extended luminescent material layer, alternative ($b_3$) provides a further increase in light efficiency by metallization of the hole walls (i.e., at the areas or portions of the hole walls where additional luminescent material is applied) between the wall surface and the luminescent material. With such structural arrangement (i.e., alterative $b_3$), any light component emitted by the luminescent material in the direction of a hole wall is at least partially reflected in the direction of the glass screen.

In instances where the structural arrangement of ($b_1$) is utilized, the resultant screen is without an additional luminescent substance layer on the hole walls and only has the metallization on the hole walls, then, increases in light efficiency are at least partially determined by the shape of the holes. Preferably, the holes are shaped so as to enlarge toward the glass screen plate, i.e., so as to angle outwardly, and thereby form a mirror for any light component emitted toward the rear (i.e., into the holes) whereby such mirror reflects, to a large extent, such rearwardly directed light component toward the front.

Shaping of the holes in the perforated plates is preferably even when a combination of additional luminescent material and metallization is utilized (i.e., the structural arrangement of alternative $b_3$).

Preferably, the perforated plate holes are intentionally shaped so that such holes resemble a frustumed parabolic space or area, which when coated with a metal layer, with or without an overcoating of the luminescent material, produces a parabolic mirror.

In preferred ($b_1$) and/or ($b_3$) embodiments of the invention, the metallization or metal layer applied onto hole walls is extended to the connecting surfaces of the perforated plate and the black border layer so that a continuous electrically conductive layer is attained. Then, during screen operation, the entire metallization can be employed as a diverter electrode for any incident electrons.

The metal layer is applied before the emplacement of the perforated screen, for example, via a cathode atomization process, or via a metal vapor deposition process whereby a defined metal layer extent is attained on the hole walls by selecting a specific deposition angle, or via a chemical vapor deposition process or via a current-less deposition from a liquid phase. During screen operation, the metal layer of the perforated plate is connected to an electrical potential which, first allows sufficient electrons to strike the wall and thus, with structure ($b_3$) strike the luminescent material located on such metal layer, second, diverts the electrons so as to prevent charging effects and, third, still leaves a sufficient amount of electrons for the luminescent points located on the glass screen, i.e., does not impair the function of the acceleration anode lying between the luminescent points and the glass screen.

Preferably, the perforated plate is composed of glass and is fused onto the black border layer positioned above a conductive layer (acceleration anode) on a glass screen. The metallic layer lying between does not impair this connection. If desired, the perforated plate may also be composed of a suitable ceramic material.

In certain preferred embodiments of the invention, the perforated plate is made of adequate thickness so that it can function as a spacer mount or member between the glass screen plate and a perforated control plate used in a gas discharge display device. Even in instances in which the perforated plate only functions as a support for further plates or elements that may be present as spacer members between the glass screen plate and the perforated control plate, the perforated plate allows a precise observance of spacing, in which the luminescent points or dots are protected.

In the drawings, a glass screen plate 1, the front of which is not fully shown but which comprises the front pane of a flat gas discharge image display device, is shown. Positioned on the interior surface 1*a* of the screen plate 1 is a conductive layer 2, having a thickness of about 0.2$\mu$ and is comprised of doped indium oxide. The conductive layer 2 functions, in an operative flat image display device, as an acceleration anode for electron beams (schematically indicated by arrows e) drawn out of the gas discharge in such so that during operation, the electron beams strike luminescent points (not shown) positioned on select areas of layer 2 device. A black border layer 3, in the form of a perforated grid which leaves surface areas 4 uncovered for emplacement of individual luminescent points (not shown in FIG. 1), is positioned on the layer 2. A perforated plate 5, having a pattern of through-holes 6 matching the pattern of uncovered surface areas 4, is positioned on the black border layer 3.

Figure 2:
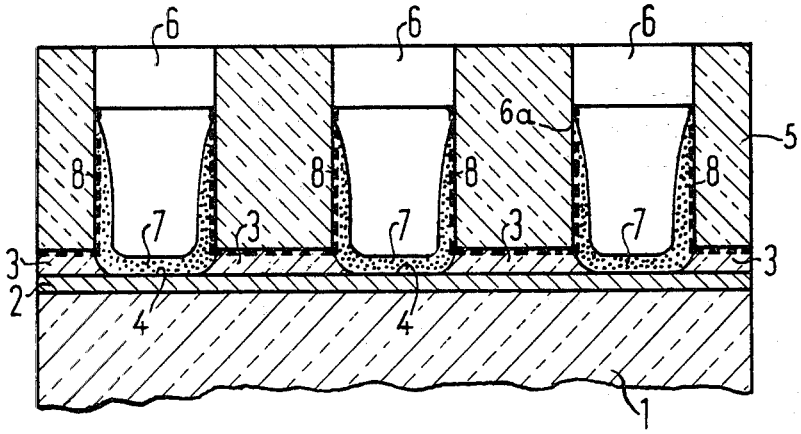
FIG. 2 is a partial elevated cross-sectional view of an embodiment of a luminescent screen constructed in accordance with the principles of the invention.

In the embodiment shown at FIG. 2, a luminescent material layer 7 is positioned so as to cover the surface areas 4 and extend upwardly along wall portions 6*a* of holes 6. The layer 7 extends upwardly approximately two-thirds of the hole depth dimension and extends into the apertures within the black border layer 3. A metal layer or metallization 8 is provided between the perforated plate 5 and the black border layer 3 and extends upward onto the wall portions 6a of holes 6 so as to be situated between the luminescent material layer 7 and the hole wall surfaces of perforated plate 5.

Such structural arrangement of an inventive luminescent screen is produced, for example, as follows. A glass solder grid is applied onto a glass screen 1 as a black border layer 3. In achieving this, a glass solder with a so-called "black dye" additive, comprised of various metal oxides with methylglycol acetate, a suitable thinner and a photo-sensitive resist, is slurried, sprayed onto the entire screen surface and, after drying, is exposed via suitable masks, for example corresponding to a three-color grid for color television, developed and dried. The practical expression "black border layer" actually denotes an opaque grid or pattern produced in foregoing manner.

The perforated plate 5 preferably comprises a 1 mm glass pane whose exterior dimensions correspond to those of glass screen 1. The holes 6 are produced either via a classic glass etching technique or via a photo-resist technique, for example as employed in commercially available photo-formed glass. The metallization ensues, for example, via vapor-deposition in a high vacuum environment so that a 100 nm thick aluminum layer 8 is formed on the respective land areas between the holes 6 and at least partially onto the hole walls 6a, as shown. The hole walls are metallized with, for example, aluminum up to a height or hole depth of approximately 0.2 mm. In this manner, given a hole wall surface area of about $0.2\times0.5$ cm$^2$, one achieves a quadrupling of the "active" surface. After alignment, the screen plate 1 and perforated plate 5 are sintered or fused to one another whereby the pre-dried glass solder grid of the black border layer 3 on screen plate 1 functions as a solder means.

Subsequently, in order to apply a pattern of luminescent material, sprayable slurries of a red phosphor (for example $Y_2O_2S$: Eu), a green phosphor (for example [Zn, Cd] S: Cu) and a blue phosphor (for example ZnS: Eu) are successively sprayed onto select surface areas, such as surface areas 4 and/or adjacent hole wall portions in a desired pattern corresponding to, for example, a standard three-color pattern for color television. Spraying can occur through magnetically retained masks comprised of steel or nickel. Such masks are positioned on a perforated plate 5 and are mechanically aligned. With a proper spray adjustment, the select un-masked surfaces of the screen plate 1 and/or the select surfaces of the wall holes are coated with a luminescent or phosphor material layer 7. Thereafter, the applied phosphor or luminescent layer (comprised of a plurality of discreet areas are dots) is degasified of any bonding agents.

Figure 3:
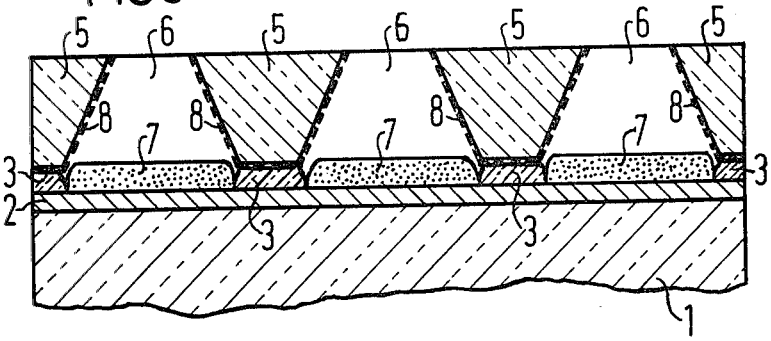
FIG. 3 is a view somewhat similar to that of FIG. 2 of another embodiment of the invention.

FIG. 3 illustrates an embodiment of a perforated plate wherein the holes 6 are conically enlarged toward the direction of the screen plate 1 (i.e., the holes 6 have larger diameters at the surface of perforated plate in contact with the screens plate than at a distance away from the screen plate). In the embodiment illustrated, the screen plate 1, the anode layer 2, the black border layer 3, the metal layer 8 and the perforated plate 5 substantially correspond to like elements of FIG. 2. However, in this embodiment, the luminescent material layer 7 is positioned only on the glass screen plate 1 and not on the walls of holes 6. Thus, in this embodiment only the mirror effect of the metal layer 8 on the hole walls is utilized for increasing light efficiency. Both the light emitted toward the back and the electrons reflected back from the luminescent material layer 7 are reflected at the metal layer 8 and are directed back onto the layer 7 whereat the resultant light is at least partially added to the light emitted toward the front and where secondary (reflected) electrons can generate further light. The shown frustumed conical shaped of holes 6 is attained, for example, by etching a glass perforated plate 5.

Figure 4:
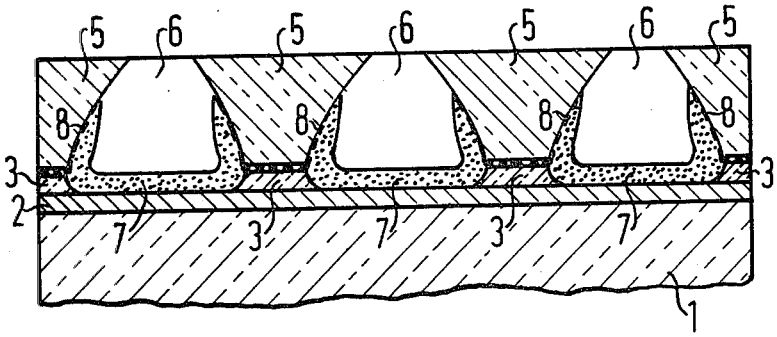
FIG. 4 is also a somewhat similar view to that of FIGS. 2 and 3 of yet another embodiment of the invention.

FIG. 4 illustrates an embodiment similar to that of FIG. 3 in that the perforated plate holes are again enlarged toward the glass screen 1 and the hole walls contain a metal layer 8. However, in this embodiment the luminescent material layer 7 is extended up onto the metal layer 8 of the hole walls. Further, in this embodiment, by appropriate etching, the hole shape approximately resembles a frustumed parabola so that parabolic mirrors are attained with the metal layers 8.

Figure 5:
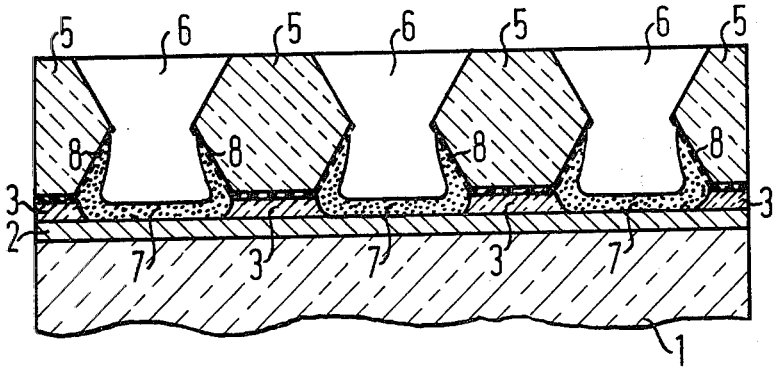
FIG. 5 is likewise a partial, elevated cross-sectional view of a further embodiment of a luminescent screen constructed in accordance with the principles of the invention.

The embodiment illustrated at FIG. 5 has a further modified hole shape within perforated plate 5. As shown, these holes are approximately shaped in the form of a double-frustumed cone, with the cone area opening toward the screen plate 1 being provided with a metal layer 8 and a luminescent material layer 7. The two-sided enlargement of holes 6 is advantageous in that the resultant conical walls can be steeper without having the rear opening of the holes 6 (i.e., on the electron beam side) become too narrow. This embodiment is preferred in those instances where the perforated plate 5 is of sufficient thickness to function as a spacer member between a glass screen 1 and a perforated control plate used in a gas discharge display device.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. In a luminescent screen for flat image display devices with electron beams drawn-out of a gas discharge with an acceleration anode for such electron beams and a plurality of luminescent point surfaces separated from one another by a black bordering layer so that during operation said electron beams strike said luminescent point surfaces, the improvement comprising:

a glass screen plate positioned on the inside of said luminescent screen supports a perforated plate above said black bordering layer, said perforated plate having a through-hole with an interior hole wall over each luminescent point surface and a light-increasing means positioned on at least portions of said hole wall adjacent and facing said glass screen plate for cooperatively interacting with said luminescent point surfaces for directing electrons reflected against said through-hole walls from the luminescent point surfaces back toward said point surfaces.

2. In a luminescent screen as defined in claim 1 wherein said through-hole walls are angled outwardly toward said glass screen plate.

3. In a luminescent screen as defined in claim 2 wherein said light-increasing means comprises a metallic layer.

4. In a luminescent screen as defined in claim 2 wherein said light-increasing means comprises a luminescent material layer.

5. In a luminescent screen as defined in claim 2 wherein said light-increasing means comprises a combination of a metallic layer and a luminescent material layer, said metallic layer being in direct surface contact with the hole wall portions and said luminescent material overlying said metallic layer.

6. In a luminescent screen for flat image display devices with electron beams drawn-out of a gas discharge with an acceleration anode for such electron beams and a plurality of luminescent point surfaces separated from one another by a black bordering layer so that during operation said electron beams strike said luminescent point surfaces, the improvement comprising:

(a) a glass screen plate positioned on the inside of said luminescent screen and supporting a perforated plate over the black bordering layer, said perforated plate having a through-hole with an interior hole wall over each luminescent point surface; and (b) the interior hole walls of said through-holes at least on wall portions thereof adjacent and facing said glass screen plate having a luminescent material layer thereon as a continuous extension of the luminescent point surface applied on a glass screen plate beneath said through-hole for cooperatively interacting with said luminescent point surface for directing electrons reflected against the through-hole walls from the luminescent point surfaces back toward said point surfaces.

7. In a luminescent screen as defined in claim 6 wherein the perforated plate through-holes are enlarged toward the side of the perforated plate facing the glass screen plate.

8. In a luminescent screen as defined in claim 6 wherein said perforated plate through-holes are enlarged in a somewhat parabolic manner to define a frustrumed parabola opening toward the glass screen plate, which when provided with a metal layer defines an approximately parabolic mirror.

9. In a luminescent screen as defined in claim 6 wherein said metal layer on the hole walls extends to the connection surfaces of the perforated plate and the black bordering layer whereby a continuous electrically conductive layer is defined.

10. In a luminescent screen as defined in claim 6 wherein said perforated plate is composed of glass and is fused onto said black bordering layer.

11. In a luminescent screen as defined in claim 6 wherein said perforated plate is of sufficient thickness to function as a spacer member between the glass screen plate and a perforated control plate used in a gas discharge display device.

12. In a luminescent screen as defined in claim 6, wherein a metal layer is positioned on said interior hole wall of the perforated plate through-hole, said through-holes being enlarged toward the side of said perforated plate facing said glass screen plate.

13. In a luminescent screen as defined in claim 6, wherein a combination of a metal layer and a luminescent material layer is positioned on said interior hole walls of the perforated plate through-hole, said luminescent material layer being positioned on said metal layer.

* * * * *